US008240265B1

(12) United States Patent
Khachaturian

(10) Patent No.: US 8,240,265 B1
(45) **Date of Patent: *Aug. 14, 2012**

(54) METHOD AND APPARATUS FOR SALVAGING UNDERWATER OBJECTS

(76) Inventor: Jon Khachaturian, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/053,694

(22) Filed: Mar. 22, 2011

Related U.S. Application Data

(63) Continuation of application No. 12/211,299, filed on Sep. 16, 2008, now Pat. No. 7,908,988.

(60) Provisional application No. 60/987,887, filed on Nov. 14, 2007.

(51) Int. Cl.
*B63C 7/00* (2006.01)

(52) U.S. Cl. ..... 114/51

(58) Field of Classification Search ..... 114/44, 114/50, 51; 414/137.1, 137.3, 137.7, 137.8, 414/785
See application file for complete search history.

(56) References Cited

U.S. PATENT DOCUMENTS 3,713,414 A * 1/1973 Wischhoefer et al. ..... 114/50
4,280,237 A * 7/1981 Petrie ..... 441/1
4,714,382 A 12/1987 Khachaturian
5,607,260 A 3/1997 Khachaturian
5,609,441 A 3/1997 Khachaturian
5,662,434 A 9/1997 Khachaturian
5,666,898 A * 9/1997 Bell ..... 114/54
5,800,093 A 9/1998 Khachaturian
5,836,463 A 11/1998 Khachaturian
5,863,085 A 1/1999 Khachaturian
5,975,807 A 11/1999 Khachaturian
6,000,562 A 12/1999 Khachaturian
6,039,506 A 3/2000 Khachaturian
6,079,760 A 6/2000 Khachaturian
6,149,350 A 11/2000 Khachaturian
6,213,319 B1 4/2001 Khachaturian
6,296,288 B1 10/2001 Khachaturian
6,318,931 B1 11/2001 Khachaturian
6,364,574 B1 4/2002 Khachaturian
6,367,399 B1 4/2002 Khachaturian
6,412,649 B1 7/2002 Khachaturian
6,425,710 B1 7/2002 Khachaturian
6,435,773 B1 8/2002 Khachaturian
6,435,774 B1 8/2002 Khachaturian
(Continued)

*Primary Examiner* — Daniel Venne
(74) *Attorney, Agent, or Firm* — Garvey, Smith, Nehrbass & North, L.L.C.; Charles C. Garvey, Jr.; Vanessa M. D'Souza

(57) ABSTRACT

A method and apparatus for removing debris from an ocean floor or seabed employs a subsea debris basket. The basket eliminates the absolute necessity of a cargo barge or any other supporting vessel that might be required to remain in a field until the objects on the ocean floor can be lifted. The present invention provides a non-weather sensitive solution. The present invention affords the safe operation in that all lifting and lowering is performed in a subsea environment next to the ocean floor or seabed. The present invention enables operation to be completed with the use of an ROV or remotely operated vehicle. The present invention provides improved offshore efficiency, less time being required to recover debris from the seabed to the underwater salvage basket or debris basket. The present invention enables the possibility of use of an A-frame or simple crane to lower debris into a subsea basket. The basket can be reused or redeployed in the field if desired. The basket may also be "reefed" in place to address the stability concerns of small debris and to minimize transit time of debris to a reef site.

16 Claims, 7 Drawing Sheets

U.S. PATENT DOCUMENTS 6,601,717 B1 8/2003 Khachaturian
6,692,190 B2 2/2004 Khachaturian
6,719,495 B2 4/2004 Khachaturian
6,843,191 B1 * 1/2005 Makotinsky ..... 114/51
7,066,343 B1 6/2006 Khachaturian
7,399,018 B1 7/2008 Khachaturian
7,908,988 B1 3/2011 Khachaturian

* cited by examiner

METHOD AND APPARATUS FOR SALVAGING UNDERWATER OBJECTS

CROSS-REFERENCE TO RELATED APPLICATIONS

This is a continuation of U.S. patent application Ser. No. 12/211,299, filed Sep. 16, 2008 (issuing as U.S. Pat. No. 7,908,988), which is a non provisional patent application of U.S. Provisional Patent Application Ser. No. 60/987,887, filed Nov. 14, 2007, each of which is hereby incorporated herein by reference.

Priority of U.S. Provisional Patent Application Ser. No. 60/987,887, filed Nov. 14, 2007, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the salvaging of underwater objects such as the remnants of hurricane damaged offshore platforms, related piping and accessories. More particularly, the present invention relates to an improved method and apparatus for salvaging underwater objects that employs a large debris basket (e.g. 45'×160') that is placed upon the seabed and wherein a floating vessel supported lifting device, such as a crane, lifts one object after another object in sequence, placing each one in the basket and without lifting the lower or distal end of the crane lifting line to the water's surface in between objects.

2. General Background of the Invention

Hurricanes have caused damage to offshore structures such as oil and gas well drilling platforms and production platforms, at times scattering pieces of the offshore structure or components thereof across the seabed. Each piece of scattered storm debris can each be very heavy and of an odd shape. These pieces/components present a hazard to workers when lifted from the seabed to be placed on a barge or other salvage vessel. Because of their often odd shape combined with heavy weight, they can shift position when lowered to a vessel deck. Therefore, handling them on a barge deck is hazardous. Such an operation must progress slowly and carefully.

These damaged offshore structures can also be a hazard to navigation. The damaged structures are often positioned next to or near oil/gas wells that must be capped. Such wells may be placed back in production at a future date. The debris from damaged offshore structures can be spread over a wide area and can hinder reestablishing the original well or wells. Lifting such objects from a seabed is a time consuming and expensive proposition. Currently, each object must be lifted from seabed to water surface, one at a time.

BRIEF SUMMARY OF THE INVENTION

The present invention provides a method and apparatus for removing debris from an ocean floor or seabed. The method employs a trussed structurally robust debris basket. The debris basket eliminates the absolute necessity of a cargo barge or any other supporting vessel that might be required to remain in a field until the objects on the ocean floor or sea bed can be lifted.

The debris basket provides an open truss/grading configuration that minimizes added mass effect. The basket dimensions and weight provide a working capacity of up to about 1,000 tons and a dynamic load factor of 1.6. Optional hook assemblies permit rapid rig and de-rig of the structure and diver-less lift and recovery. The method and apparatus of the present invention enable operation with no need for a cargo barge or supporting vessel required to remain in the field.

The method of the present invention provides a safe operation in that all lifting and lowering of items to be salvaged occurs in the subsea environment. Any rigging that is necessary can be completed with the use of an underwater remotely operated vehicle or ROV. The method of the present invention enables the possibility to use an A-frame or simple crane to lower debris into the subsea basket in the marine environment.

The present invention provides a non-weather sensitive solution. The present invention affords the safe operation in that all lifting and lowering is performed in a subsea environment next to the ocean floor or seabed. The present invention enables operation to be completed with the use of an ROV or remotely operated vehicle for placing lifting rigging on each object to be salvaged.

The present invention provides improved offshore efficiency, less time being required to recover debris from the seabed to the underwater salvage basket or debris basket. With the present invention, each object to be salvaged is not lifted all the way to the water surface.

The present invention enables the possibility of use of an A-frame or simple crane to lift the objects/debris to be salvaged from the seabed a short distance (i.e. the overall height of the side wall of the debris basket) and then lower the object/debris into the basket.

The basket can be reused or redeployed in the targeted debris field if desired. The basket may also be "reefed" in place to address any stability concerns of small debris or small objects to be salvaged. The present invention minimizes transit time of debris to a selected or approved reef site as all salvaged items and collected debris are transported within the debris basket.

The present invention provides an improved method and apparatus for salvaging items from a seabed by employing a structurally robust, trussed debris basket that is placed near the debris field or near the multiple objects to be salvaged.

A remotely operated underwater vehicle or "ROV" can optionally be used to prepare rigging and attach it to each of the items to be salvaged. Once each of the items to be salvaged is properly rigged, a crane or like lifting device can be attached to each object. The object is then lifted a short distance, i.e. high enough to clear the sidewall of the basket. The object is then placed into the basket.

The method of the present invention enables the salvaging of underwater objects even in storm conditions. Because the objects are placed in the basket while they are subjected to the buoyancy contributed by the surrounding seawater, center of gravity issues with the lifting apparatus are avoided. Further, significant time and money are saved because each object to be lifted is not pulled all the way to the water surface, a distance that can be hundreds of feet.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
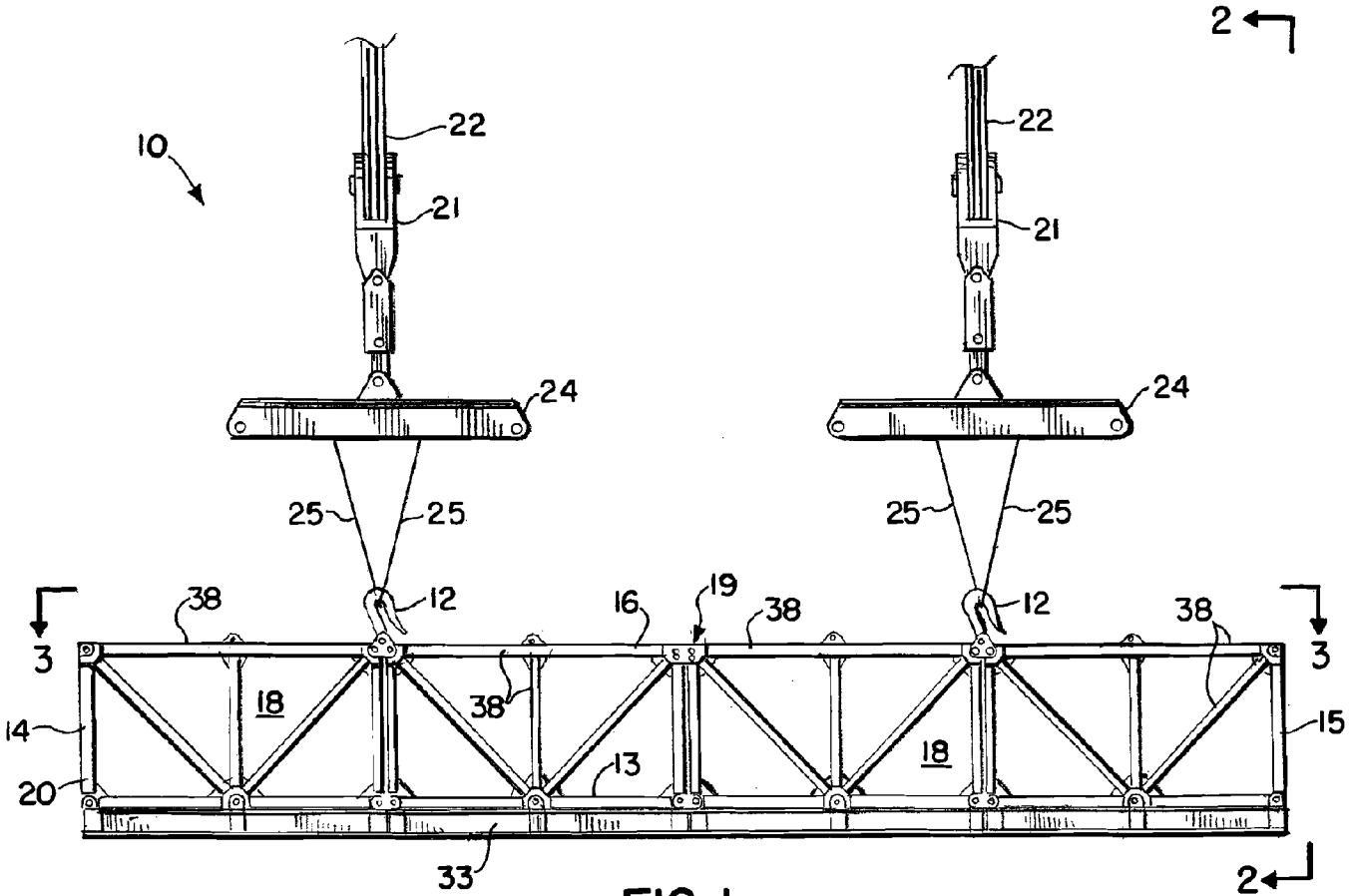
FIG. 1 is a perspective view of the preferred embodiment of the apparatus of the present invention.

FIGS. 1-7 show the preferred embodiment of the apparatus of the present invention, designated generally by the numeral 10. FIGS. 1-7 show the method of the present invention. The present invention provides a marine salvaging system 10. System 10 structurally robust, specially configured and trussed debris basket frame 20. Frame 20 (FIGS. 1-7) is used as part of the method of the present invention for salvaging items from a seabed 11.

As part of the method, the debris basket frame 20 is placed on a seabed 11 wherein it remains until it has been filled with multiple articles P to be salvaged. These articles P to be salvaged can include pieces or sections of an offshore marine platform, pipe sections, spool pieces, vessels, equipment, and/or pieces of the platform jacket as examples.

Because debris basket 10 remains on seabed 11, objects P to be salvaged can be lifted one at a time using a marine crane or other lifting device 23 (e.g. derrick barge, lift barge, catamaran lifting device). Lifting device 23 places those items P in basket frame 20. After a number of items have been placed in basket frame 20, basket frame 20 can be either left on the seabed 11 as an artificial reef or lifted to the water surface area 27, deposited upon a work vessel, barge, or the like.

Debris basket frame 20 can be fitted with a plurality of hooks 12 for enabling basket frame 20 to be lifted with a marine crane or derrick barge or other lifting device 23 using appropriate rigging (e.g. see FIGS. 1, 2, 4 and 6-7). Lifting device 23 employs one or more lifting lines 22, blocks 21 and a spreader 24. Slings 25 extend from spreader 24 to hooks 12 of frame 20 (see FIG. 2). The basket frame 20 has a floor or bottom panel 13, end panels or walls 14, 15 and side panels or walls 16, 17. The end walls 14, 15 and side walls 16, 17 surround an interior 18 that communicates with an open top 19. Articles P to be salvaged are added one at a time to basket frame 20 via open top 19 according to the method of the present invention.

Each of the walls, panels or sections 13-17 is preferably a structurally robust, trussed panel or section. This construction provides a basket frame 20 that can be very large and carry a heavy multi-ton load. The dimensions of basket frame 20 should be large enough to enable very large objects (e.g. piping sections, process vessels, spool pieces, portions of marine oil/gas platforms) P to be salvaged. These objects P can be placed within the interior 18 of basket frame 20 and contained there (see FIGS. 5-7). This operation can be conducted even in rough sea conditions or in strong currents because the objects P are not lifted to a pitching, heaving vessel deck.

Bottom 13 may be made of serrated grating 35 or non-serrated grating. Preferably, bottom 13 has multiple openings 37 to allow water to flow through bottom 13. Walls 14, 15, 16 and 17 can be in the form of one or more trusses 38. Bottom panel 13 can provide longitudinal beams 33 and transverse beams 34 (see FIG. 3). Grating 35 can be attached (e.g. bolted or welded) to beams 33, 34 to form a floor 36 having openings 37 that enable water to pass through floor 36 during use.

Figure 2:
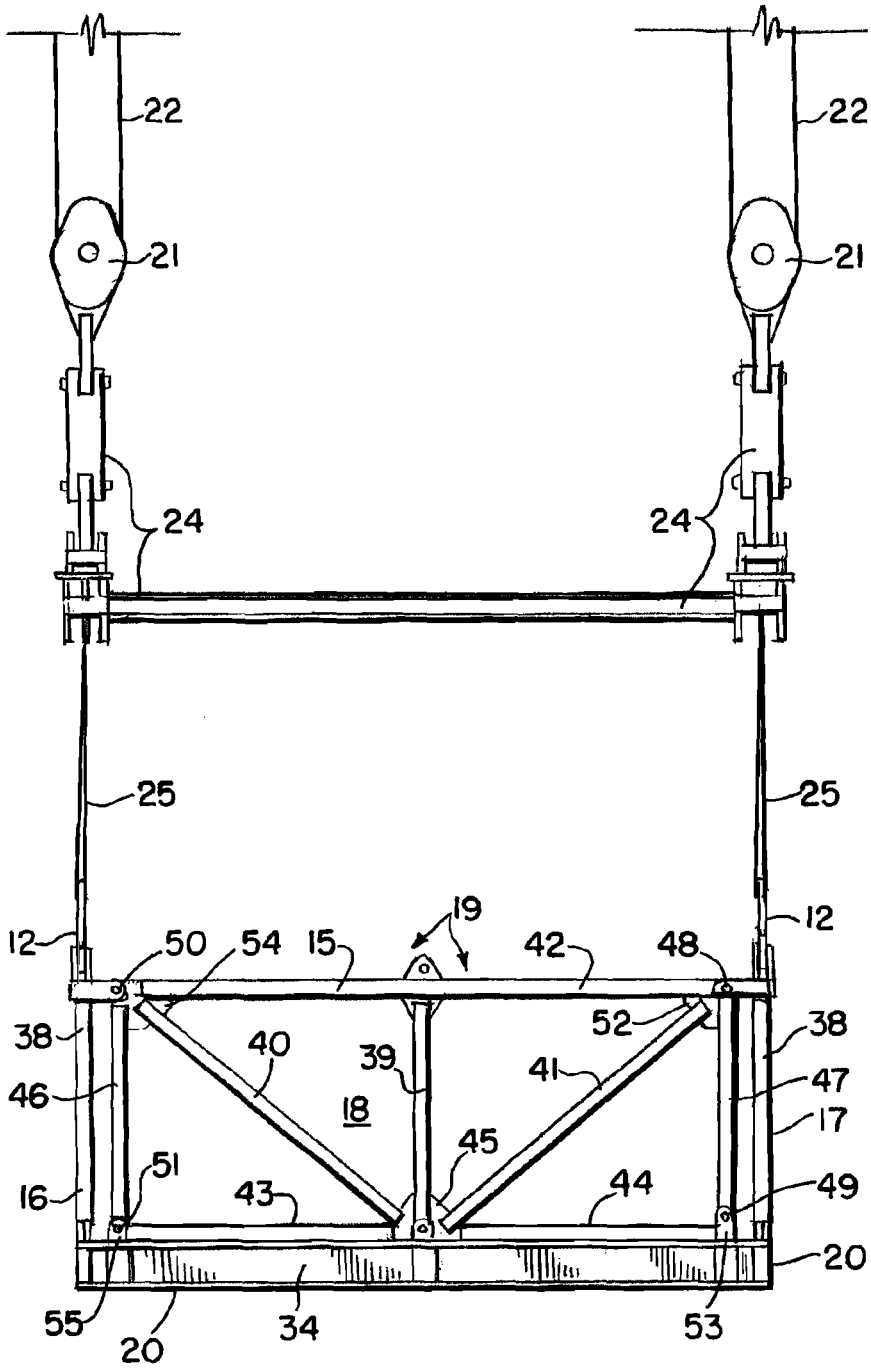
FIG. 2 is an end view of the preferred embodiment of the apparatus of the present invention, taken along lines 2-2 of FIG. 1.
Figure 3:
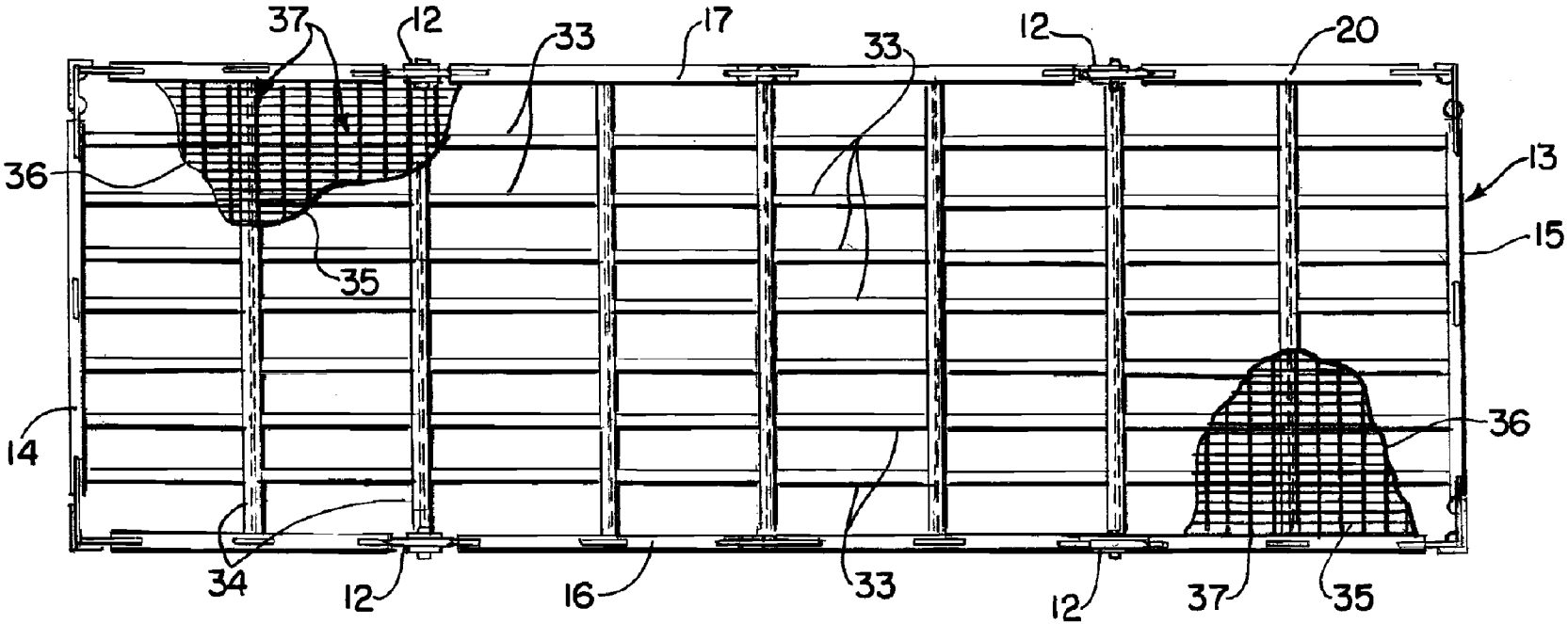
FIG. 3 is an elevation view of the preferred embodiment of the apparatus of the present invention, taken along lines 3-3 of FIG. 1.
Figure 4:
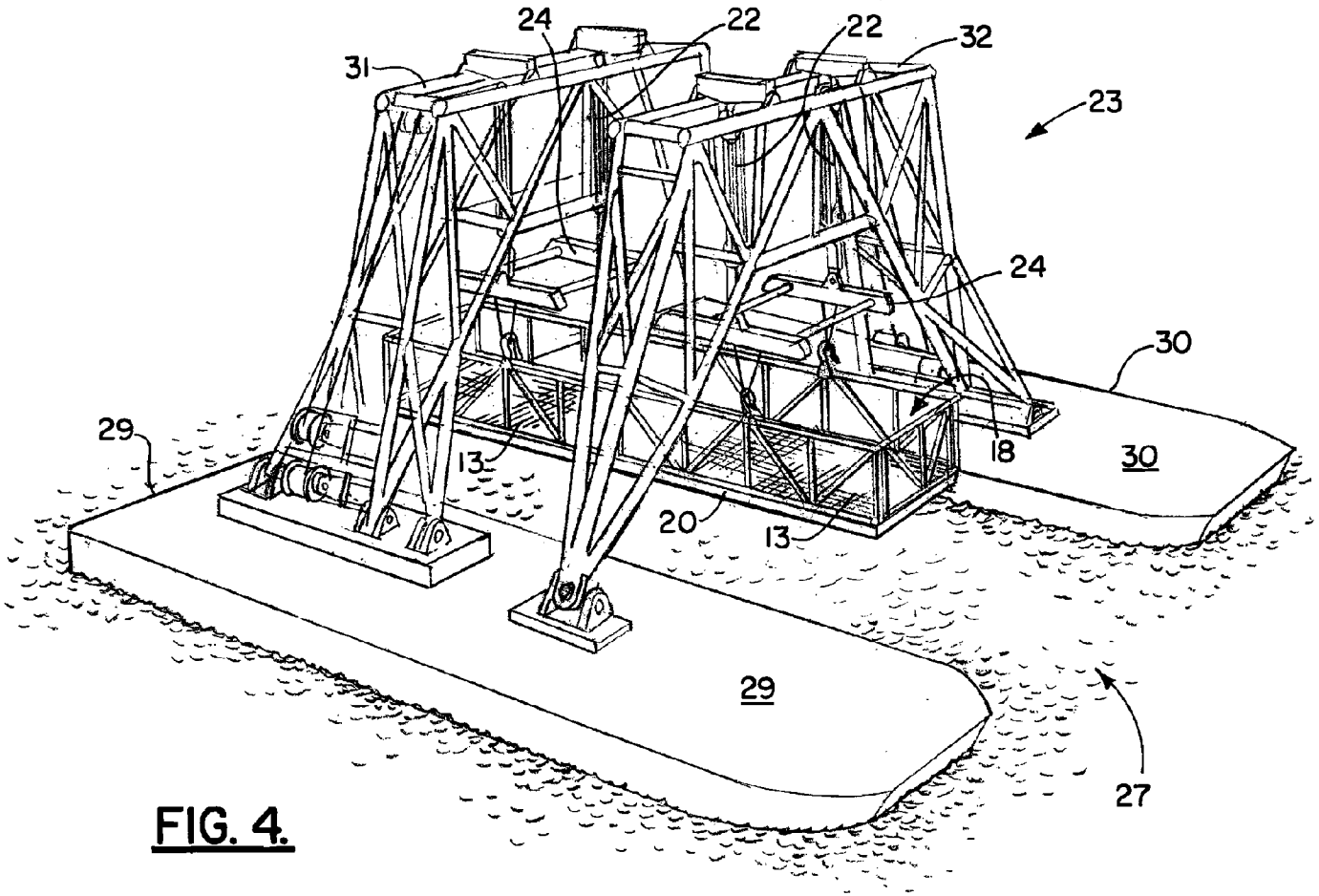
FIG. 4 is a perspective view of the preferred embodiment of the apparatus of the present invention.

Each wall of panel 14, 15, 16, 17 can be formed of one or more trusses. Each end wall 14, 15 can be in the form of a truss 38 as seen in FIG. 2. The end walls 14, 15 can be identically configured to each provide a center column 39 and diagonal members 40, 41. Truss 38 provides upper horizontal member 42 and lower horizontal members 43, 44. Each of the members 39, 40, 41, 43, 44 is connected (e.g. welded) to a plate 45 (see FIG. 2).

Truss 38 in FIG. 2 can include vertical columns 46, 47. Columns 46, 47 can be attached to upper horizontal member 42 and a lower horizontal member 43 or 44 as seen in FIG. 2 at connections 48, 49, 50, 51. Each side panel or side wall 16, 17 can be constructed of one or more trusses 38. In FIG. 1, each side wall 16, 17 is constructed of four trusses 38 as shown. Each truss 38 can be as shown in FIG. 2. Each truss 38 can employ corner plates 52, 53, 54, 55 at corners of the truss 38. Plates 52, 53, 54, 55 connect an end wall 14 or 15 to side walls 16, 17.

Figure 5:
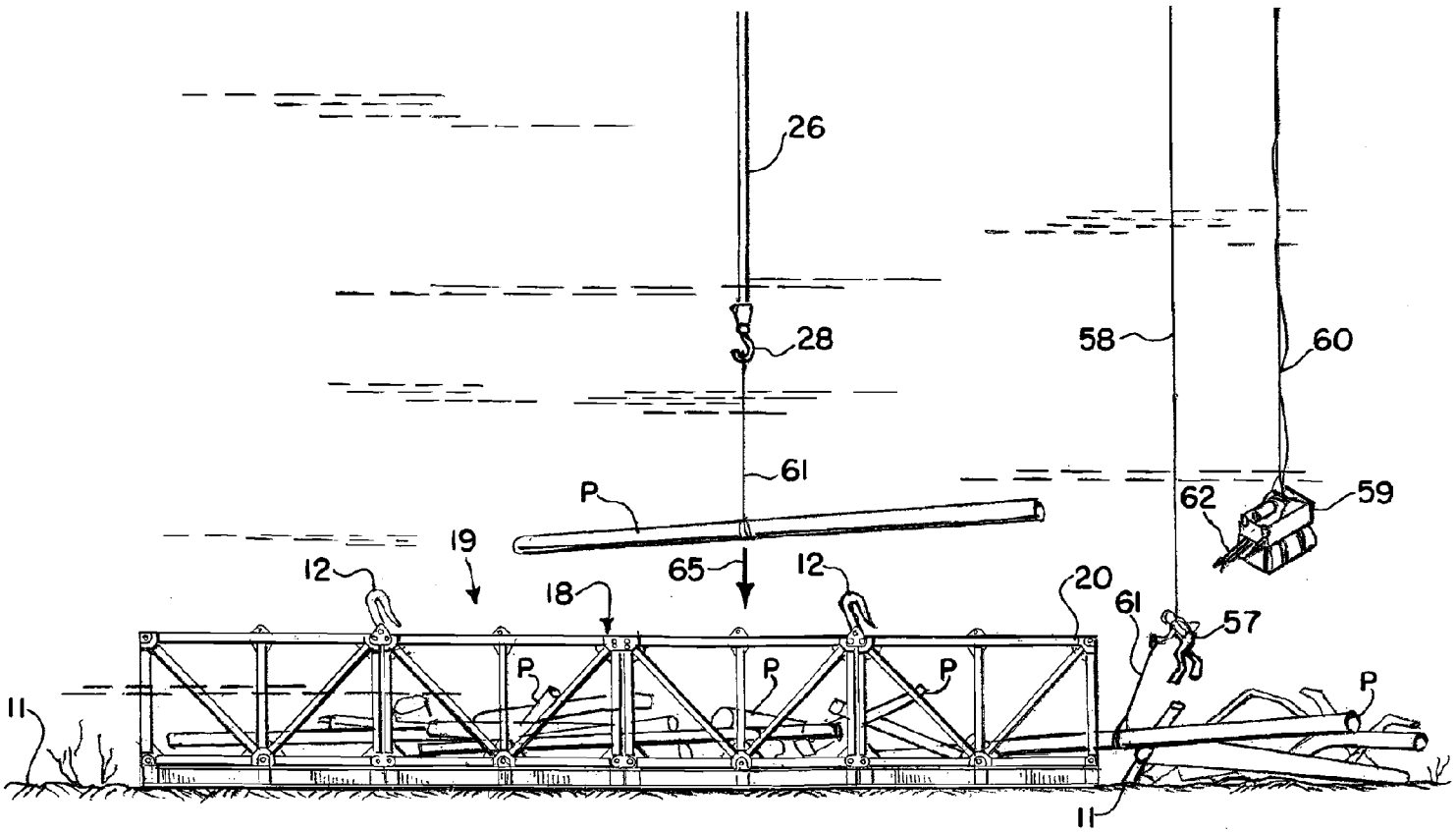
FIG. 5 is a partial perspective view of the preferred embodiment of the apparatus of the present invention and illustrating the method of the present invention.

In FIG. 5, there can be seen numerous articles to be salvaged, each being designated by the reference letter P. These articles P to be salvaged can include for example pieces or sections of an offshore marine platform, pipe sections, spool pieces, vessels, equipment, and any other item that is deposited on the seabed after a storm that damages an offshore marine structure.

A diver 57 can be employed to attach rigging to each object P that is to be lifted from the seabed 11 and placed within interior 18 of basket frame 20. The diver 57 is supported by known support cabling and/or support hoses 58. A diver 57 is shown in FIG. 5 attaching rigging 61 to an object P that is to be salvaged. In FIG. 5, the object P with rigging 61 attached is an elongated joint of pipe. A remotely operated vehicle (or ROV) 59 is supported by a suitable surface vessel, with cabling or hoses 60. ROV 59 provides an arm 62 that can be used to attach the rigging 61 to hook 28 of lifting line 26. The lifting line 26 can be the lifting line of the lifting device 23 shown in FIG. 6 or the lifting line 26 could be of any other lifting line, such as the line of a derrick barge, crane or the like.

In FIG. 5, the hook 28 need only lift the object P to be salvaged a distance high enough to place it above the walls 14, 15, 16, 17 of basket frame 20. The object P is then lowered into the interior 18 of basket frame 20 as indicated by arrow 65 in FIG. 5.

The method of the present invention is an improvement over prior art systems because the objects P to be salvaged are only lifted a short vertical distance from the seabed before being placed into basket frame 20, a short vertical distance that can be for example between about 5 and 20 feet. The method of the present invention is safer than prior art methods, because the diver 57 and remotely operated vehicle 59 can be moved away from the immediate area once the rigging 61 is attached between the object P to be lifted and the crane hook 28. Additionally, buoyancy assists in lifting each object P to be lifted from the seabed 11 and placed in the basket frame 20. This enables use of a smaller lift crane, or one of lower capacity to reduce costs.

Because these lifting operations are carried on underwater and next to the seabed 11, these operations can be conducted even in less than perfect weather. Because the objects P to be lifted are handled at the seabed 11 and not on the deck of a support vessel, there is no danger of injury to a worker. At the surface, such injury could be caused by a shifting of position or rolling of an object P that is salvaged. In the prior art, such objects were lifted all the way to the water surface area and placed on a work vessel or barge. Such objects P that were lifted from the seabed could roll or shift on deck and hurt nearby workers.

The method of the present invention eliminates the need to travel all the way from the seabed 11 to the water surface 27 with each and every article P that is to be salvaged. The method of the present invention can provide for the formation of an artificial reef by leaving the basket frame 20 on the seabed 11 after it has been filled with articles P. In such a case, the basket prevents scattering of the objects P.

Figure 6:
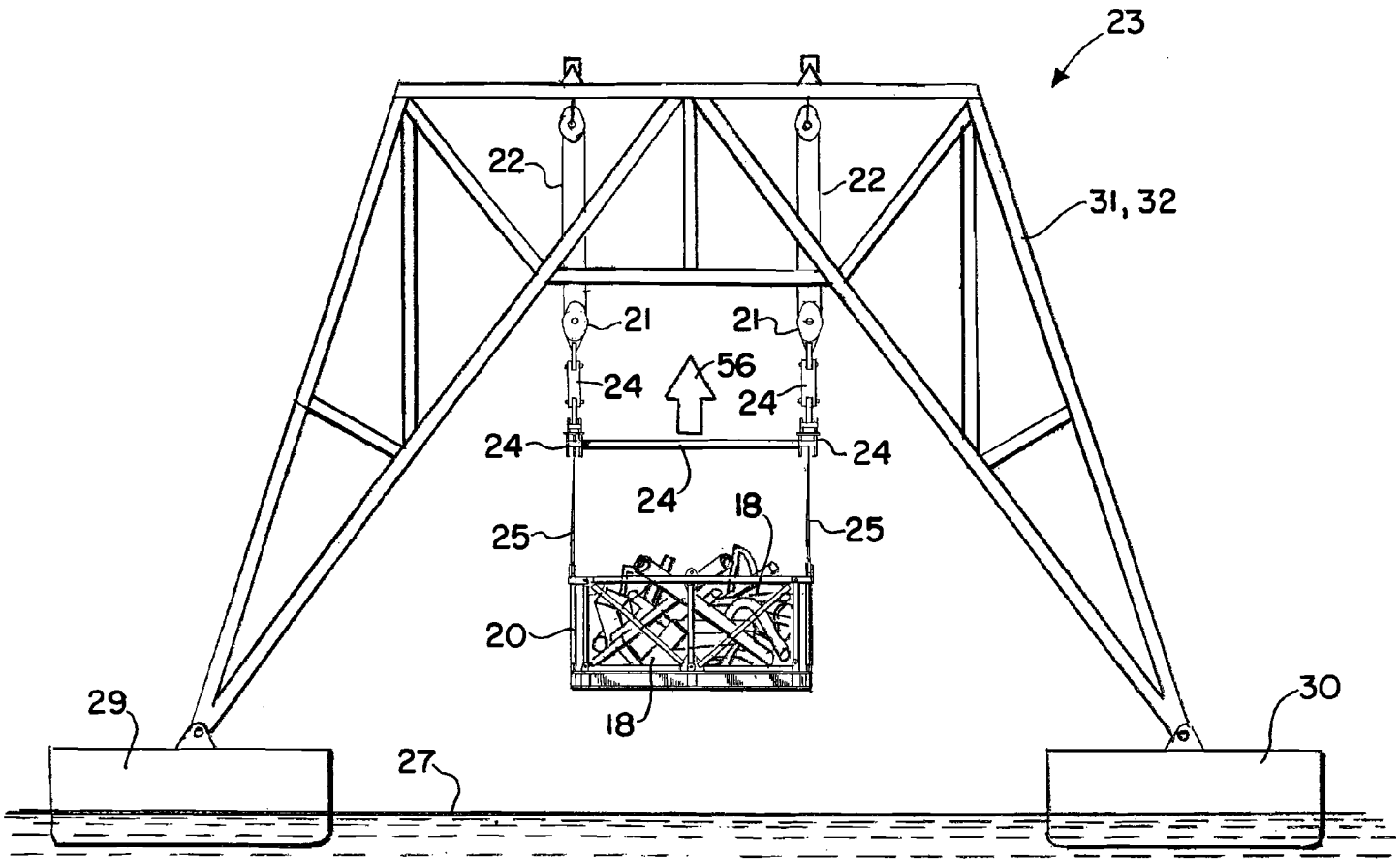
FIG. 6 is an elevation view of the preferred embodiment of the apparatus of the present invention.
Figure 7:
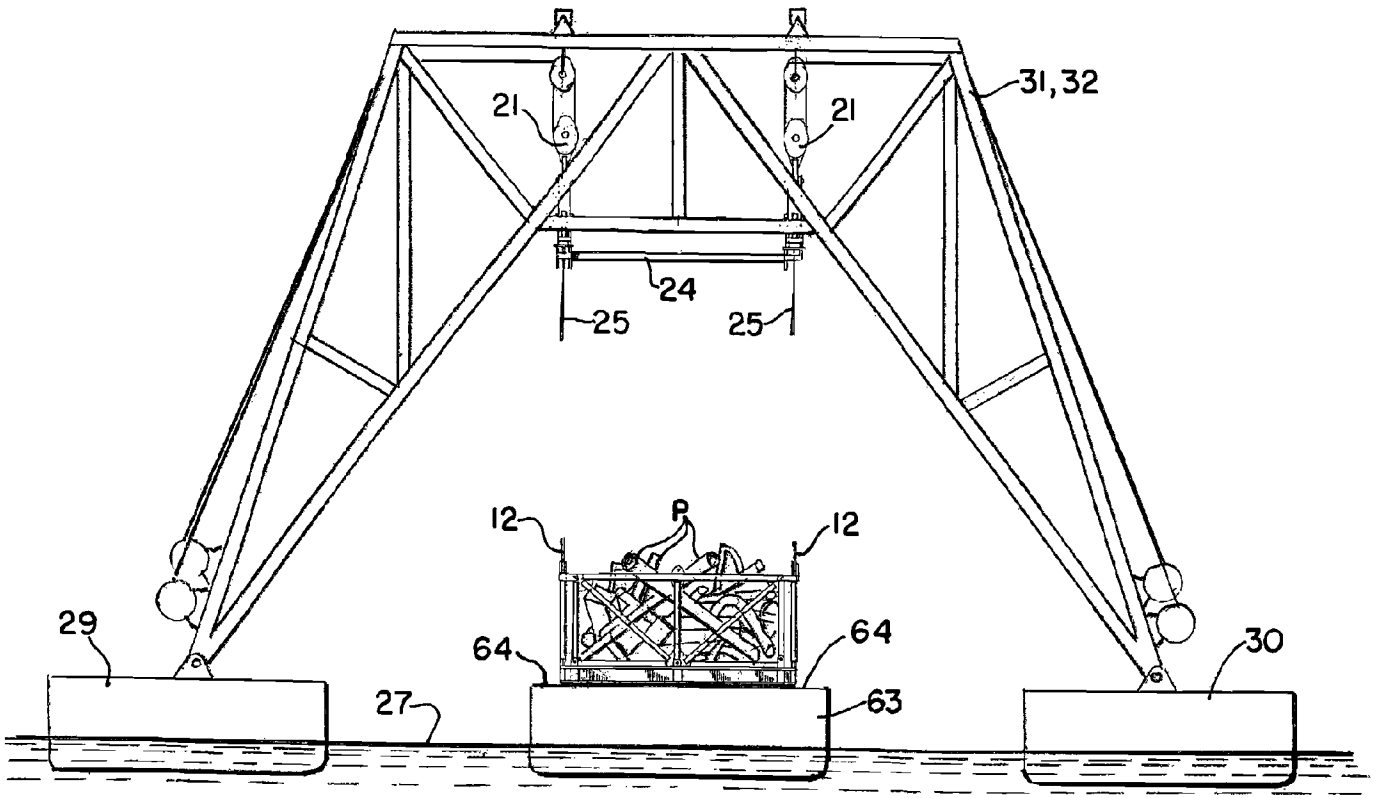
FIG. 7 is an elevation view of the preferred embodiment of the apparatus of the present invention.

In FIGS. 6 and 7, the method of the present invention lifts basket frame 20 from the seabed 11 to the water surface 27 and above the water surface 27 as shown in FIG. 6. This upward travel of the basket frame 20 is indicated schematically by the arrow 56 in FIG. 6.

In FIG. 7, a transport vessel 63 has been placed under the basket frame 20. The lifting apparatus 23 then lowers the basket frame 20 as filled with salvaged articles P to the deck 64 of the transport vessel 63. After detaching the slings 25 (see FIG. 7) the transport vessel 63 can be transported using a tug or tugs to a selected locale.

FIGS. 1-7 show an arrangement for lifting debris basket 10 from seabed 11 to water surface 27. The lifting device can be a catamaran lifting apparatus 23 that is shown and described in more detail in my copending application Ser. No. 11/610,271, filed Dec. 13, 2006, and entitled "Marine Lifting Apparatus" and hereby incorporated herein by reference. Such lifting apparatus can also be seen at www.vbar.com/om-landing/.

This heavy lift salvage apparatus 23 (commercialized under the mark "bottom feeder" as noted in the above referenced web site) is capable of lifting heavy objects such as pieces of a platform, a platform jacket, sections of piping or other such objects and/or debris from the ocean floor or seabed 11 and placing them within debris basket 10 interior 18.

Catamaran lifting apparatus 23 provides a pair of spaced apart hulls 29, 30 and a pair of trusses 31, 32, each truss 31, 32 standing between the hulls 29, 30. As with the crane or derrick barge 23, catamaran lifting apparatus 23 lifts each object P to be salvaged only a short distance above the seabed 11 before placing the object P into open top 19 of basket 10, lowering it to basket interior 18 and upon basket bottom panel/floor 13. A derrick barge 20 or catamaran lifting apparatus 23 need only lift the object P to be salvaged high enough to clear the elevation of basket 10 side panel 16 or 17 or end panel 14 or 15. During this lifting and lowering of the object P to be salvaged, buoyancy of the surrounding water contributes to the lift, removing complex center of gravity problems incurred if the object P to be salvaged is lifted clear of the water, and above water surface 27. The method of the present invention is thus more favorable for foul weather/rough seas than the lifting of objects P clear of the water and to a second vessel/barge that is in addition to the derrick barge 20 or catamaran lifting apparatus 23 or other such marine lifting device.

The following is a list of parts and materials suitable for use in the present invention.

PARTS LIST

| Part Number | Description |
|---|---|
| 10 | marine salvaging system |
| 11 | seabed |
| 12 | hook |
| 13 | bottom panel/floor |
| 14 | end panel/wall |
| 15 | end panel/wall |
| 16 | side panel/wall |
| 17 | side panel/wall |
| 18 | interior |
| 19 | open top |
| 20 | basket frame |
| 21 | block |
| 22 | lifting line |
| 23 | boom, crane, lifting device |
| 24 | spreader |
| 25 | sling, rigging |
| 26 | lifting line |
| 27 | water surface area |
| 28 | hook |
| 29 | hull |
| 30 | hull |
| 31 | truss/frame |
| 32 | truss/frame |
| 33 | longitudinal beam |
| 34 | transverse beam |
| 35 | grating |
| 36 | floor |
| 37 | opening |
| 38 | truss |
| 39 | center column |
| 40 | diagonally extending member |
| 41 | diagonally extending member |
| 42 | upper horizontal member |
| 43 | lower horizontal member |
| 44 | lower horizontal member |
| 45 | plate |
| 46 | vertical member |
| 47 | vertical member |
| 48 | connection |
| 49 | connection |
| 50 | connection |
| 51 | connection |
| 52 | corner plate |
| 53 | corner plate |
| 54 | corner plate |
| 55 | corner plate |
| 56 | arrow |
| 57 | diver |
| 58 | support cabling/hoses |
| 59 | remotely operated vehicle |
| 60 | support cabling/hoses |
| 61 | rigging |
| 62 | arm |
| 63 | transport vessel |
| 64 | deck |
| 65 | arrow |
| P | articles to be salvaged (for example, pieces or sections of an offshore marine platform, pipe sections, spool pieces, vessels, equipment, pieces of the platform jacket) |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method of salvaging multiple objects from a seabed, comprising the steps of:

a. providing a marine lifting apparatus that includes a floating hull and a lifting device supported upon the hull, the lifting device having a lifting line that is extendable from the water surface to the seabed;

b. lowering a trussed debris basket to the seabed using the lifting line, the basket having a sidewall or sidewalls, an open top and an interior;

c. attaching the lifting line to a first of the objects to be salvaged;

d. placing the first object of step c into the basket interior via the open top;

e. attaching the lifting line to additional objects to be salvaged in sequence;

f. in step e placing each additional object to be salvaged into the basket interior via the open top; and g. wherein in steps d through f multiple of the objects to be salvaged are not lifted from the seabed to the water surface; and h. wherein one of the objects is a damaged marine platform.

2. The method of claim 1, further comprising lifting the basket to the water surface after step g.

3. The method of claim 1, further comprising not lifting the basket to the water surface after step g.

4. The method of claim 1, wherein at least one object to be salvaged is all or part of an offshore oil well drilling platform that has been storm damaged.

5. The method of claim 1, wherein at least one object to be salvaged is all or part of an offshore oil well production platform that has been storm damaged.

6. The method of claim 1, wherein at least one object to be salvaged is a section of piping.

7. The method of claim 1, wherein at least one object to be salvaged is a pipe spool piece.

8. The method of claim 1, wherein at least one object to be salvaged is a piece of equipment from a storm damaged oil and gas well drilling platform.

9. The method of claim 1, wherein at least one object to be salvaged is a piece of equipment from a storm damaged oil and gas well production platform.

10. A method of salvaging a storm damaged oil well platform from a seabed, comprising the steps of:

a. providing a marine lifting apparatus that includes a floating hull adapted to be transported upon on the seabed and a lifting device supported upon the hull, the lifting device having a lifting line that is extendable from the water surface to the seabed;

b. lowering a trussed debris basket to the seabed using the lifting line, the basket having a sidewall or sidewalls, an open top and an interior;

c. attaching the lifting line to a first part of the platform to be salvaged;

d. placing the first part of the platform of step c into the basket interior via the open top;

e. attaching the lifting line to additional parts of the platform to be salvaged in sequence;

f. in step e placing each additional part of the platform to be salvaged into the basket interior via the open top; and g. wherein in steps d through f multiple of the objects to be salvaged are not lifted from the seabed to the water surface.

11. The method of claim 10, further comprising lifting the basket to the water surface after step g.

12. The method of claim 10, further comprising not lifting the basket to the water surface after step g.

13. The method of claim 10, wherein at least one object to be salvaged is a section of piping.

14. The method of claim 10, wherein at least one object to be salvaged is a pipe spool piece.

15. The method of claim 10, wherein at least one object to be salvaged is a piece of equipment from a storm damaged oil platform.

16. A method of salvaging a storm damaged oil well platform from a seabed, comprising the steps of:

a. providing a marine lifting apparatus that includes a floating hull and a lifting device supported upon the hull, the lifting device having a lifting line that is extendable from the water surface to the seabed;

b. lowering a trussed debris basket to the seabed using the lifting line;

c. attaching one or more lifting lines to the platform to be salvaged;

d. lifting the platform to be salvaged from the seabed a distance;

e. placing the platform of step c into the basket;

f. wherein the platform to be salvaged is not lifted from the seabed to the water surface before step e.

* * * * *